US005618054A

United States Patent [19]

Fagot

[11] Patent Number: 5,618,054

[45] Date of Patent: Apr. 8, 1997

[54] SKI COMPRISING A BODY AND AT LEAST ONE CAP, A TIP AND/OR A TAIL MANUFACTURED INDEPENDENTLY, AND PROCESS FOR MANUFACTURING SUCH A SKI

[75] Inventor: Jacques Fagot, La Manche, France

[73] Assignee: Skis Rossignol S.A., Voiron, France

[21] Appl. No.: 576,046

[22] Filed: Dec. 21, 1995

Related U.S. Application Data

[63] Continuation of Ser. No. 105,933, Aug. 13, 1993, abandoned.

[30] Foreign Application Priority Data

Aug. 24, 1992 [FR] France ..... 9210339

[51] Int. Cl.[6] ..... A63C 5/12

[52] U.S. Cl. ..... 280/610; 280/809; 425/542

[58] Field of Search ..... 280/601, 602, 280/608, 609, 610, 809; 425/542, 588

[56] References Cited

U.S. PATENT DOCUMENTS

| | | | |
|---|---|---|---|
| 3,876,216 | 4/1975 | Wehr . | |
| 4,071,264 | 1/1978 | Legrand | 280/610 |
| 4,616,842 | 10/1986 | Echevin et al. | 280/602 |
| 4,861,063 | 8/1989 | Abondance | 280/609 |
| 5,143,394 | 9/1992 | Piana | 280/602 |

FOREIGN PATENT DOCUMENTS

| | | |
|---|---|---|
| 1535/87 | 8/1988 | Australia . |
| 0123635 | 10/1984 | European Pat. Off. . |
| 0459347 | 12/1991 | European Pat. Off. . |
| 2556841 | 6/1977 | Germany . |

*Primary Examiner*—Richard M. Camby
*Attorney, Agent, or Firm*—Oliff & Berridge

[57] ABSTRACT

Ski comprising a body and at least one cap, i.e., tip or tail element made independently. According to the invention, the cap is made of a synthetic material molded in situ on a frame associated at least in part with the reinforcing frame of the ski body.

20 Claims, 4 Drawing Sheets

SKI COMPRISING A BODY AND AT LEAST ONE CAP, A TIP AND/OR A TAIL MANUFACTURED INDEPENDENTLY, AND PROCESS FOR MANUFACTURING SUCH A SKI

This is a Continuation of application Ser. No. 08/105,933 filed Aug. 13, 1993, now abandoned.

BACKGROUND OF THE INVENTION

The invention relates to a ski comprising a body and at least one cap, i.e., a tip element and/or a tail element manufactured independently, and a process for manufacturing said ski.

It is known that skis can be manufactured with the tip having mechanical characteristics different from those of the body of the ski, in particular, to produce greater flexibility thereby promoting safety in the event of impact.

German patent document DE 2,556,841 discloses a ski of traditional design land structure in which the tip incorporates an element made of a material more flexible than the body of the ski between its upper and lower surfaces, while ensuring continuity with the surfaces of the body of the ski.

U.S. Pat. No. 3,876,216 to Wehr discloses a ski whose tip is covered with an element made of a flexible material with a rounded end for safety reasons.

European Patent 0,123,635 discloses a ski comprising a tip made of synthetic material mounted on the front end of the ski, said ski having a short zone bent slightly upward beyond the point of contact of the front of the body of the ski with the snow.

In the case of the latter two references, the respective surfaces of the body of the ski and the tip element intended to come in contact with one another must be carefully prepared to allow proper adjustment favoring attachment by gluing, clipping, or other similar type of assembly. In practice, however, these skis have definite separation limits, especially at the tip. The tip area is subjected to particular stress, both during skiing, when the tip receives impacts that can originate with striking small obstacles, such as pieces of ice, and when handled by the user, when the ski is at risk of falling and the tip hitting the ground. Such impacts eventually result in breakage or displacement of the tip element relative to the body of the ski, resulting at least in formation of a slight gap, which is unattractive and not functional, between the body of the ski and the tip.

SUMMARY OF THE INVENTION

A goal of the invention then, is to provide a ski which can be manufactured industrially, for example by using the techniques of molding synthetic material thereby minimizing the finishing operations.

Another goal of the invention is to provide a perfect connection between the cap and the body of the ski, with this connection being made not only at the outer surfaces to ensure continuity from an appearance standpoint, but also at the structural level to ensure continuity of the mechanical characteristics between the body of the ski and the cap.

Still another goal is to ensure a good fit at the interface between the body and the cap.

Other goals are likewise taken into account by the invention, relating to the safety provided by a cap made of a relatively flexible material, the possibility of shaping the cap without being obliged to perform certain specific operations, and the possibility of altering the inertia of the cap and especially the inertia of the tip area of the ski.

Moreover, while it is ordinarily necessary to limit the magnitude of suspended masses forming the tip in certain ski structures that are especially subject to vibration, it may be advantageous for a ski whose body is much lighter, for instance, when the body of the ski has a foam core made of expanded synthetic material, to provide caps that are heavier in order to promote the precision with which the ski is guided. In the case of skis with very light bodies, the user does not perfectly feel the reactions of the skis on the snow, so the user steers poorly, especially in turns. In order to restore these sensations, it is advantageous to increase the weight at the end(s) of the skis, which can be accomplished by modifying the nature of the materials making up the cap(s).

The ski according to the invention can achieve these several goals. To this end, in the ski of the invention, the cap is made of a synthetic material molded in situ on a frame which belongs, at least partially, to the reinforcing frame of the ski body.

Further, the body of the ski, produced in an initial operation, can have a traditional structure. That is, it can be constituted by disposition in layers or piling up of different components assembled together by gluing, or can have a foam core made of injected synthetic material.

The fact that the cap, i.e., tip and/or tail, are molded on the ski body makes it possible to obtain, at the end of the molding operation, a finished ski without further finishing operations. Thus, a finished ski is formed that has excellent continuity of the mechanical characteristics at the ends, in view of the fact that the caps contain frames that likewise belong to the reinforcing frame of the ski body.

According to one embodiment of this ski, each cap is made of a flexible synthetic material chosen from the following: thermoplastic polyurethanes, casting polyurethanes, block polymer etheramide, and polyamides. The material is selected based on the amount of flexibility desired for the cap, especially the tip element. For reasons of safety and similarly with an eye toward the magnitude of the suspended masses, it is advantageous to increase or decrease the magnitude of the suspended masses depending on the nature of the ski body.

The frame of the cap has a structure that allows mechanical attachment of the synthetic material forming the cap. This mechanical attachment can be accomplished by virtue of the open-worked structure of the frame that can be composed of a wide-meshed fabric or an open-worked metal, or, in cases when the frame is composed of an element with a solid structure, this element is shaped so that it has steps or shoulders for attachment of the material that constitutes the cap.

The frame on which the cap is molded can be continued along the entire length of the ski body and project completely to the two ends thereof, or can be implanted in only a portion of the length of the body (preferably at least 10 cm), and it can be composed of one or several reinforcing elements, which may or may not be different.

The connecting surface between the cap and ski body can have a generally planar form, or can have a complex surface. In the latter case one can obtain decorative effects which are very attractive by imbricating/overlapping the edge of the ski body and the cap, especially on the upper surface of the ski.

According to another embodiment of the invention, the synthetic material constituting the tip can cover the ski body locally to produce an excess thickness.

One process for manufacturing this ski which is designed to be fitted with a tip or tail element, comprises making a ski body in which the frame elements are allowed to project beyond each end of said body, introducing each end comprising the frame elements into a mold, and molding the cap in question by injecting synthetic material.

BRIEF DESCRIPTION OF THE DRAWINGS

The invention will be clearly understood from the following description with reference to the attached schematic diagrams showing as nonlimiting examples, a plurality of embodiments of this ski.

DETAILED DESCRIPTION OF PREFERRED EMBODIMENTS

Figure 1:
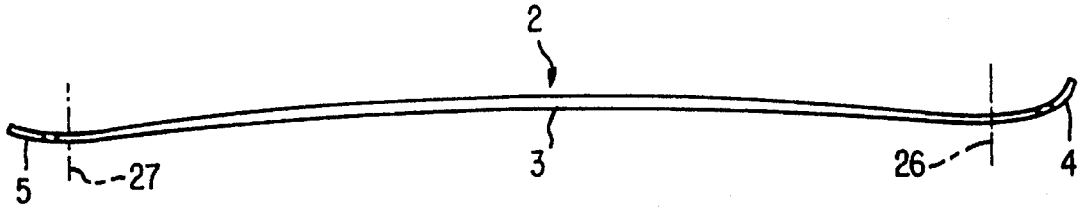
FIG. 1 is a highly schematic side view of a ski according to the invention.
Figure 2:
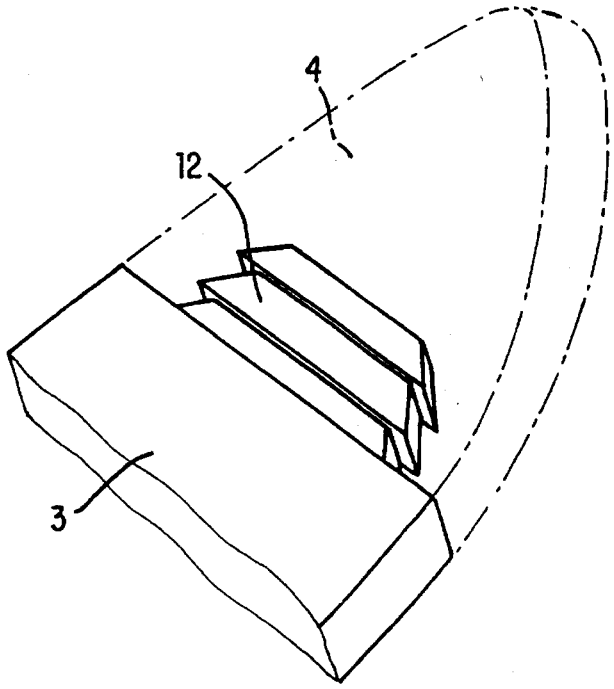
FIG. 2 is a perspective view of a front end of a ski body.

A ski 2, shown in FIG. 1, comprises a ski body 3, whose front end is provided with a tip 4 and whose rear end is equipped with a tail 5. The tip 4 and tail 5 comprise caps which are produced directly onto the ski body. The interface between the tip cap 4 and the ski body 3 is located ahead of the front line of contact 26 of the ski body with the snow, while the interface between the tail cap 5 with the ski body 3 is located behind the rear line of contact 27 of the ski body with the snow.

Figure 3:
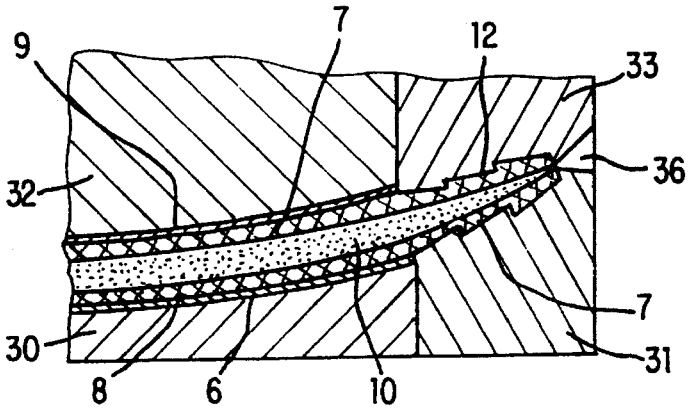
FIGS. 3 and 4 are two longitudinal sections through the front end of this same ski, as well as the mold required for its two phases of production.
Figure 4:
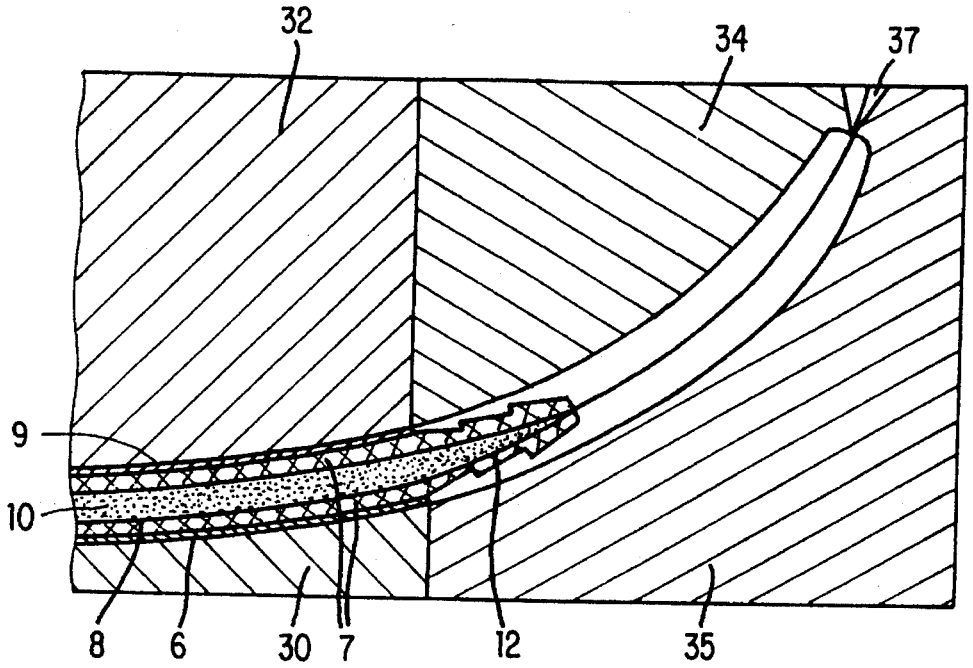
Figure 5:
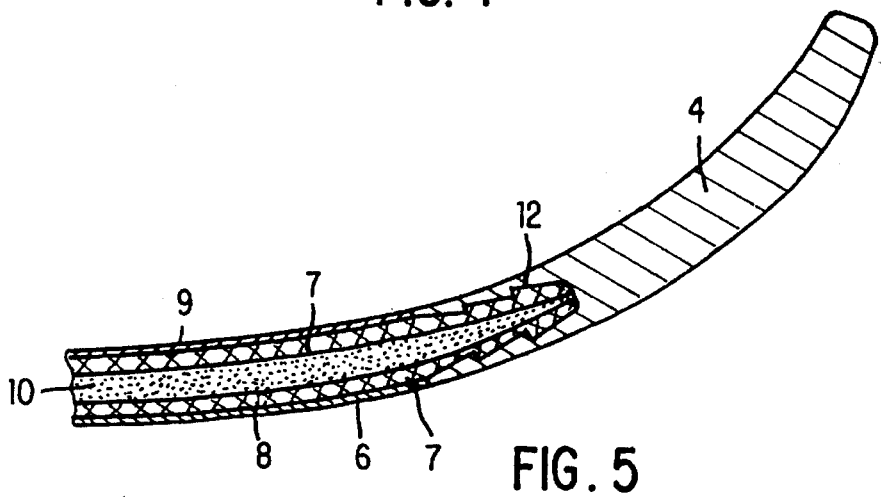
FIG. 5 is a longitudinal section through the front end of this same ski after completing manufacture.

FIGS. 2 to 5 show a first embodiment of a front end of a ski body 3. FIGS. 3 and 4 show the manufacturing process for the ski shown in FIG. 5. The sides (not shown), the running surface 6, and a reinforcing frame 7, composed for example, of two layers of glass fiber impregnated with resin are placed in the bottom of the mold (constituted by parts 30 and 31).

A case 8 which is impermeable and extensible is inserted between these two layers after putting in place upper wall 9 and then the mold is closed with the aid of two-part cover 32 and 33. Then, through orifice 36, injecting a foam made of synthetic material such as polyurethane, into the central part, inside case 8, to obtain core 10. During this injection, case 8 is filled with polyurethane foam which, upon expansion, frame element 7 in glass cloth presses against the outer wall of the mold, allowing the front end of the ski body to protrude from the body, comprising shoulders 12. Following a short period of polymerization of the two resins, epoxy of impregnation of the fabrics and polyurethane constituting the core 10 of ski 2, the two parts of the mold 31 and 33 only are opened and removed, and two other parts 34 and 35 (see FIG. 4) are installed, with the ski body always remaining positioned in mold 30, 32. Through orifice 37, injection of a synthetic material such as casting polyurethane, results in the formation of tip 4. After curing and removal from the mold, the ski is obtained in its final form without any requirement for further operations, with tip 4 being the perfect extension of the ski body, as far as mechanical characteristics are concerned, because frame 7 of the ski body 3 is extended inside the tip 4 and produces a perfect attachment of the latter thanks to the presence of shoulders 12.

In the figures which follow, like elements are designated by the same reference numerals as above.

Figure 6:
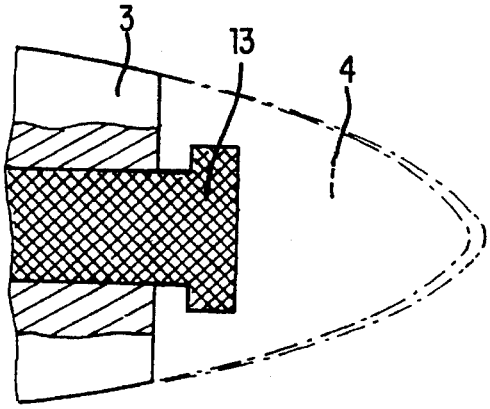
FIGS. 6 to 8 are three top views of the front end of a ski, with three different frame elements.

In the embodiment of the invention shown in FIG. 6, the frame is constituted by an open-worked element 13 such as a netting, which promotes the attachment of the synthetic material constituting the tip, with the holding of the tip being improved by the T-shape of the front end of the frame.

Figure 7:
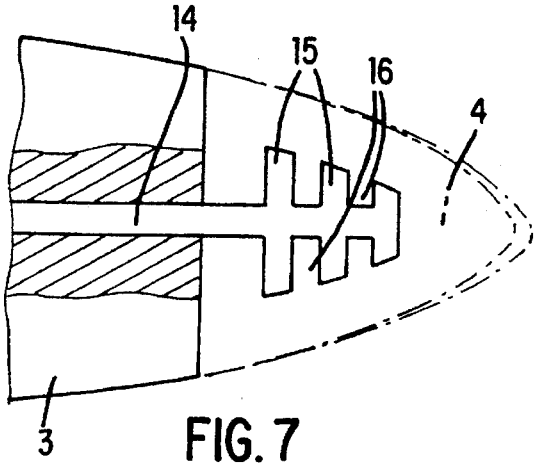

In the embodiment of the invention shown in FIG. 7, the frame is composed Of a metal strip 14 which has, in the area associated with the tip 4, an enlarged part 15 in which cuts 16 are provided for mechanical attachment of the synthetic material constituting the tip.

Figure 8:
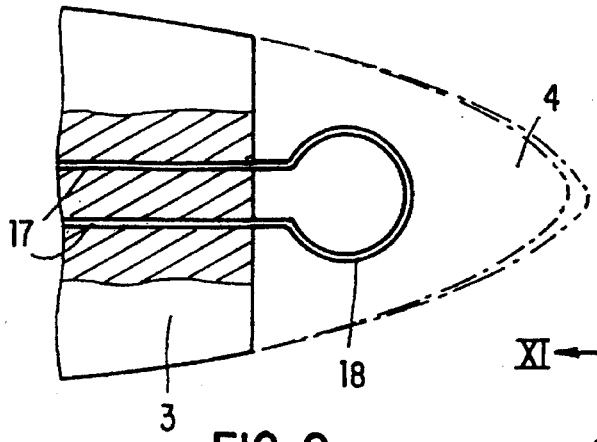

In the embodiment of the invention shown in FIG. 8, the frame is constituted by a metal wire 17, reversed inside the tip to form a loop 18.

In the above embodiments, the surface for connection between the tip 4 and body 3 of the ski is generally flush, i.e., perpendicular to the longitudinal axis of the ski.

Figure 9:
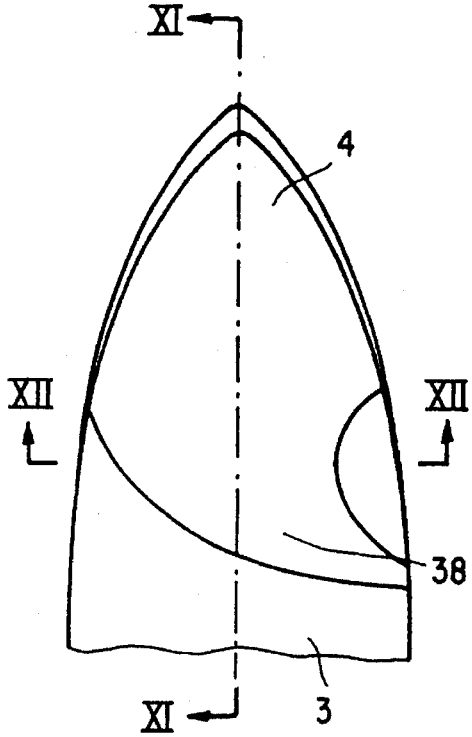

FIGS. 9 to 12 show a variation of this ski in which the connecting surface has a complex shape, allowing imbrication of tip cap 4 and ski body 3 that results in an attractive surface produced directly by molding, as shown in FIG. 9.

Figure 10:
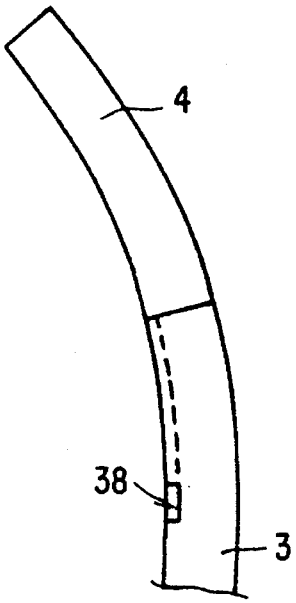
FIGS. 9 and 10 are two views taken from above and from the side respectively, showing the front end of a ski after molding the tip.
Figure 11:
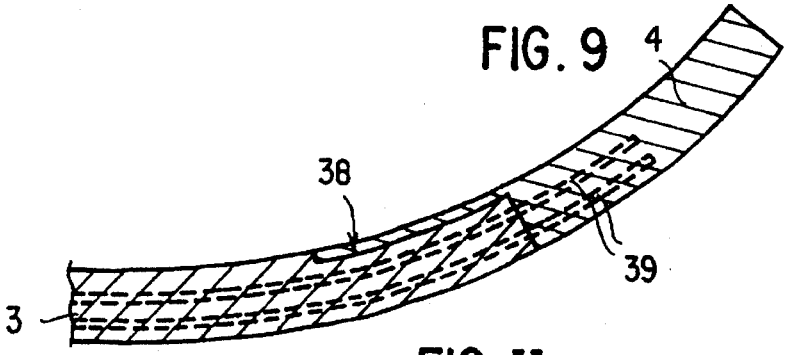
FIG. 11 is a section of this same ski along line XI—XI.
Figure 12:
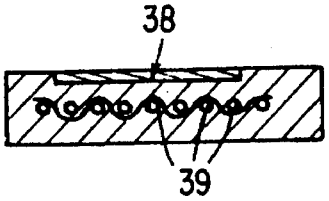
FIG. 12 is a view of a ski according to the invention, sectioned along XII—XII.
Figure 13:
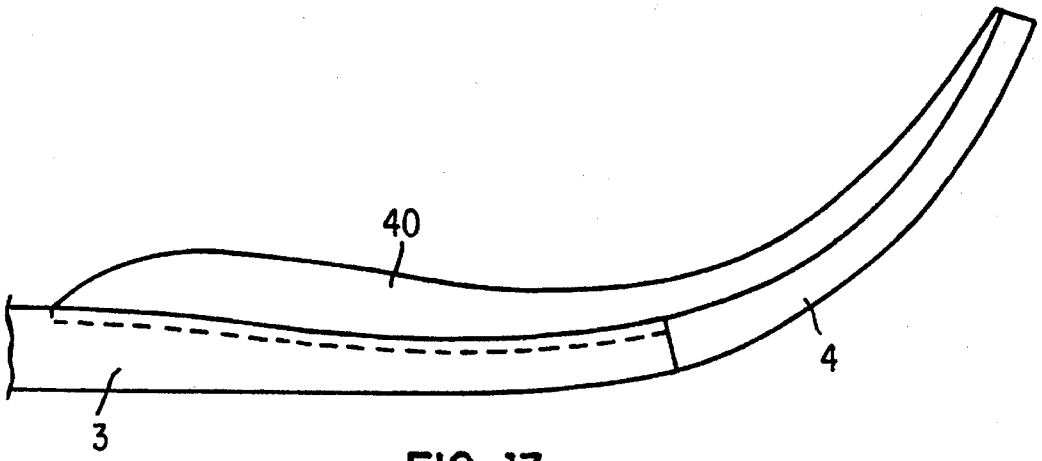
FIGS. 13 and 14 are two views of the side and top respectively of the front end of another ski.
Figure 14:
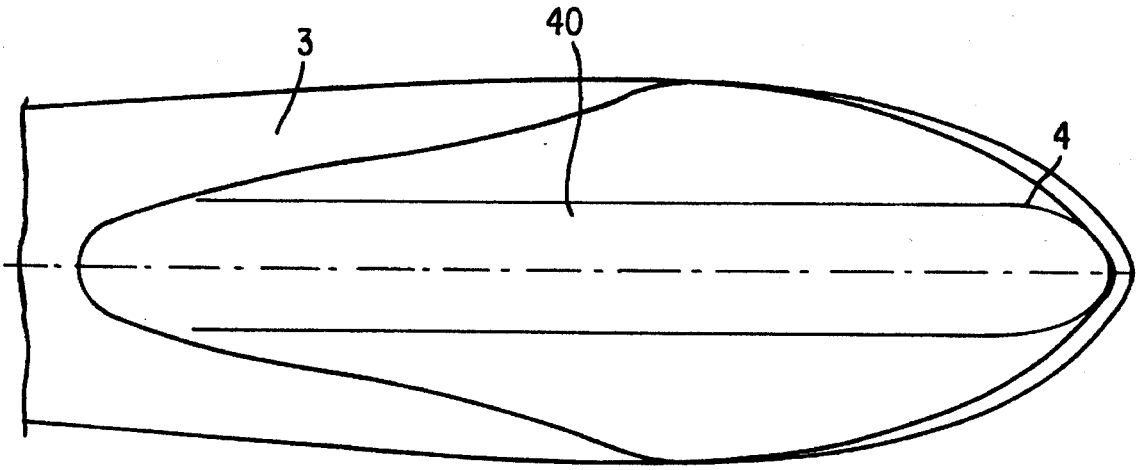

In this embodiment of the invention, the material constituting the tip 4 is extended above the upper part of the ski. In this case, the mold cover 33 used for the first stage is altered for molding the ski body, making a recess 38, this recess Will then be filled up by the material constituting the cap, as can be seen in FIGS. 9 and 10. In FIG. 11, reinforcing frame 39 is double. In FIG. 12, the frame is made of a grill of laminated glass FIGS. 13 and 14 show another variation of the invention which makes it possible to produce localized excess thickness 40 on the upper surface of the ski.

As follows from the above, the invention represents a considerable improvement in existing technology by providing a ski with a simple structure, easily manufactured, and making it possible to obtain different characteristics for the ski body and for the ends thereof, i.e., the tip and the tail.

What is claimed is:

1. A ski, comprising:

a body comprising front, middle and rear portions; and at least one reinforcing frame that is implanted in the body, wherein at least a portion of the at least one reinforcing frame protrudes from at least one of the front and rear portions; and at least one cap that is attached to the protruding portion of the at least one reinforcing frame, wherein the at least one cap is molded around the protruding portion of the at least one reinforcing frame after the body has been formed.

2. Ski according to claim 1, wherein the at least one cap is made of a flexible synthetic material selected from the group consisting of: thermoplastic polyurethanes, casting polyurethane, block polymer etheramides, and polyamides.

3. Ski according to claim 1, wherein the reinforcing frame of the body has a structure that promotes mechanical attachment of the at least one cap to the body.

4. Ski according to claim 3, wherein the reinforcing frame comprises at least one element with a solid structure, shaped to have shoulders that promote attachment of the cap to the body.

5. Ski according to claim 3, wherein the reinforcing frame extends along the entire length of the body and extends longitudinally beyond the front and rear portions of the body.

6. Ski according to claim 1, wherein a thickness of the at least one cap is substantially the same as a thickness of an adjoining portion of the body.

7. Ski according to claim 3, wherein the reinforcing frame comprises a plurality of reinforcing elements.

8. Ski according to claim 1, wherein a material comprising the at least one cap covers at least a portion of an outer surface of the body.

9. Ski according to claim 3, wherein the reinforcing frame comprises an element having a plurality of apertures.

10. Ski according to claim 9, wherein a material comprising the at least one cap infiltrates the apertures of the protruding portion of the at least one reinforcing frame during molding to bond the at least one cap to the body.

11. Ski according to claim 1, wherein the protruding portion of the at least one reinforcing frame has a generally flat planar shape.

12. Ski according to claim 1, wherein the body further comprises a channel formed in a surface portion of the body adjacent the at least one cap, and wherein a portion of the material comprising the at least one cap extends into the channel.

13. Ski according to claim 1, wherein the at least one cap comprises a flexible synthetic material.

14. Ski according to claim 1, wherein the protruding portion of the at least one reinforcing frame has an irregular shape, and wherein a material comprising the at least one cap conforms to the irregular shape of the protruding portion during molding to bond the at least one cap to the body.

15. Ski according to claim 1, wherein the protruding portion of the at least one reinforcing frame comprises a core portion and at least one protruding portion, and wherein a material comprising the at least one cap conforms to the shape of the protruding portion during molding to bond the at least one cap to the body.

16. A method of manufacturing a ski, comprising the steps of:

forming a ski comprising a body having front and rear portions and at least one reinforcing frame that is implanted in the body, wherein a portion of the at least one reinforcing frame protrudes from at least one of the front and rear portions;

introducing the protruding portion of the at least one reinforcing frame into a cap mold;

injecting a synthetic material into the cap mold;

curing the synthetic material injected into the cap mold to form an integral cap that surrounds the protruding portion of the at least one reinforcing frame; and removing the ski from the cap mold.

17. The method of claim 16, wherein the protruding portion of the at least one reinforcing frame includes a plurality of apertures, and wherein the step of injecting a synthetic material into the cap mold further comprises injecting the synthetic material into the cap mold so that the synthetic material infiltrates the plurality of apertures.

18. The method of claim 16, wherein the protruding portion of the at least one reinforcing frame has an irregular shape, and wherein the step of injecting a synthetic material into the cap mold further comprises injecting the synthetic material into the cap mold so that the synthetic material conforms to the irregular shape of the protruding portion.

19. The method of claim 16, wherein a surface portion of the ski body adjacent the protruding portion of the at least one reinforcing frame includes a channel, and wherein the step of injecting a synthetic material into the cap mold further comprises injecting synthetic material into the cap mold so that the synthetic material enters the channel on the ski body.

20. The method of claim 16, further comprising the step of providing a cap mold having a shape such that a thickness of a cap to be formed around the protruding portion is substantially the same as a thickness of an adjacent portion of the ski body.

* * * * *